US005306852A

United States Patent [19]

Cosyns et al.

[11] Patent Number: 5,306,852

[45] Date of Patent: Apr. 26, 1994

[54] PROCESS FOR SELECTIVE HYDROGENATION, IN PARTICULAR OF DIOLEFINS IN STEAM CRACKING VOLATILES, WITH A CATALYST IN THE FORM OF BEDS WHICH ARE USED SUCCESSIVELY

[75] Inventors: Jean Cosyns, Maule; Patrick Sarrazin, Rueil Malmaison; Jean-Paul Boitiaux, Poissy; Charles Cameron, Paris, all of France

[73] Assignee: Institut Francais Du Petrole, Rueil Malmaison, France

[21] Appl. No.: 10,386

[22] Filed: Jan. 28, 1993

[30] Foreign Application Priority Data

Jan. 28, 1992 [FR] France ..... 92 00992

[51] Int. Cl.[5] ..... C07C 5/09

[52] U.S. Cl. ..... 585/254; 585/259; 585/265; 585/310

[58] Field of Search ..... 585/258, 259, 260, 254, 585/265, 310

[56] References Cited

U.S. PATENT DOCUMENTS

| | | | |
|---|---|---|---|
| 3,705,204 | 12/1972 | Tatsuo Horie | 585/259 |
| 3,926,784 | 12/1975 | Christman et al. | 208/210 |
| 4,560,815 | 12/1985 | Agarwal | 585/259 |
| 4,704,492 | 11/1987 | Nemet-Maurodin | 585/260 |
| 4,960,960 | 10/1990 | Harrison et al. | 585/265 |

FOREIGN PATENT DOCUMENTS 0026508 4/1981 European Pat. Off. .

*Primary Examiner*—Anthony McFarlane
*Attorney, Agent, or Firm*—Millen, White, Zelano, & Branigan

[57] ABSTRACT

The invention concerns a hydrogenation process, in particular for the selective hydrogenation of diolefins in volatiles produced by steam cracking or other cracking processes, in which the catalyst is distributed in a plurality of beds. It is characterized in that the different catalyst beds are not used at the same time, but successively and in accordance with a given order.

8 Claims, 1 Drawing Sheet

PROCESS FOR SELECTIVE HYDROGENATION, IN PARTICULAR OF DIOLEFINS IN STEAM CRACKING VOLATILES, WITH A CATALYST IN THE FORM OF BEDS WHICH ARE USED SUCCESSIVELY

FIELD OF THE INVENTION

The invention concerns a hydrogenation process and more particularly a process for the selective hydrogenation of diolefins in liquid hydrocarbon cuts, such as, for example, steam cracking volatiles. Such volatiles do in fact contain compounds which generate gums containing diolefins mixed with olefinic compounds and aromatic compounds. In order to put those olefinic compounds and aromatic compounds into usable form, the diolefins have to be subjected to selective hydrogenation.

BACKGROUND OF THE INVENTION

Such treatment operations are generally carried out over metal catalysts deposited on an amorphous or crystalline carrier. The metals used are metals of group VIII, for example, nickel and palladium.

The highly unstable character of such pyrolysis volatiles makes treatment thereof relatively difficult because, simultaneously with the hydrogenation effect, a polymerisation reaction occurs on the catalyst, which causes clogging and deactivation of the catalyst. In order to compensate for that loss of activity, the operating temperature is progressively increased but that mode of procedure further increases the rate at which polymeric deposits occur. In consequence it is necessary periodically to halt operation in order to carry out a combustion operation on the catalyst in order to restore its initial activity. Halting the operation represents a real loss of production and the combustion operation has to be carried out with a very high degree of precision in order to avoid irreversible degradation of the properties of the catalyst. Any improvement in the process which will permit an increase in the cycle time, that is to say the period of time between two combustion operations, will substantially enhance the quality of the process.

Carrying out the hydrogenation operation itself involves a system for the removal of heat, as the degree of exothermicity is such that the catalyst would be damaged by the excessively high temperatures which occur at the discharge from the catalyst bed. The above-indicated operation of removing heat can be effected by exchange with a heat exchange fluid in a reactor-exchanger, the catalyst being kept in the tubes and the heat exchange fluid being discharged at the shell side. Such a procedure, which is referred to as isothermal, is complicated and requires the use of highly burdensome reactors.

The use of chamber-type reactors is generally preferred and control of the exothermicity of the reaction is effected by substantial recycling of hydrogenated product to the top of the bed. One improvement involves dividing the catalyst into two beds and cooling the effluent from the first bed by means of a quench liquid formed by cold hydrogenated product.

Nonetheless, such a procedure is not entirely satisfactory as the whole of the catalyst is subjected to the polymerization effect, which in many cases causes a premature stoppage of the operation due to an excessive pressure drop at the intake to the section.

SUMMARY OF THE INVENTION

The object of the invention is therefore to prolong the operating time of the useful charge of catalyst by bringing the whole of the catalyst charge into service progressively, instead of bringing it into operation in its entirety from the start. It has in fact been surprisingly found that it was better to use the minimum amount of catalyst in a progressive reactor system rather than to follow the known practice of having a substantial excess of catalyst at the beginning of operation which practice was aimed at compensating for deactivation of the first part of the bed.

The process according to the invention therefore comprises distributing the catalyst in a plurality of beds, and preferably in the same reactor, and bringing the beds into service in succession. A fresh bed of catalyst is added at the head as soon as necessary, for example, when the level of performance of the mass of catalyst in operation is inadequate to give a product which complies with the relevant specifications.

More precisely the invention is a process for the hydrogenation of a hydrocarbon charge by contacting it with p catalytic beds $n_1 \ldots n_i \ldots n_p$, said beds being separate and containing the same catalyst. The process being characterized in that (A) the charge is introduced into the bed $n_p$ and the resulting product $p_p$ is extracted, (B) when the product $p_p$ does not attain a desired quality, the introduction of the charge into the bed $n_p$ is stopped and (C) simultaneously the charge is introduced into the bed to produce a product $p_{p-1}$, (D) the product $p_{p-1}$ is introduced into the bed $n_p$ and the resulting product $p_p$ is extracted. These steps are carried out progressively such that when the product $p_p$ falls below the desired quality, the introduction of the charge into the bed $n_i$ is stopped, at the same time the charge is introduced into the bed $n_{i-1}$, the product obtained $p_{i-1}$ being introduced into the bed $n_i$, and so on until i has assumed all whole values from p to 1.

The invention will be better appreciated by referring to the description of FIGS. 1 and 2.

DETAILED DESCRIPTION OF THE INVENTION

Prior to the invention, the known art involved using an entire mass M of catalyst to obtain a product $p_p$ complying with the required specifications, for a cycle time D (or operating time).

When the product $p_p$ exhibited specifications worse than the required specifications (that is to say when the product $p_p$ no longer attained the desired quality S), the reactor was stopped and the catalyst was regenerated.

In accordance with the invention the mass M of catalyst, or an amount smaller than that mass, is divided into p beds ($n_1$, $n_i$, $n_p$), which are distributed among one or more reactors, each containing at least the minimum amount of catalyst required to achieve the desired specifications. Each time that the product $p_p$ no longer attains the desired level of quality, the feed of the charge is displaced to the bed $n_{i-1}$ disposed upstream of the bed $n_i$, in such a way that the charge to be treated passes successively through the new catalyst bed $n_{i-1}$, then the product issuing from that bed passes through the spend catalyst bed $n_i$, bed the product obtained from that bed, $p_i$, passes through the spent catalyst $n_{i+1}$ etc, until the bed $n_p$ is passed through, and the product $p_p$ is obtained.

Figure 1:
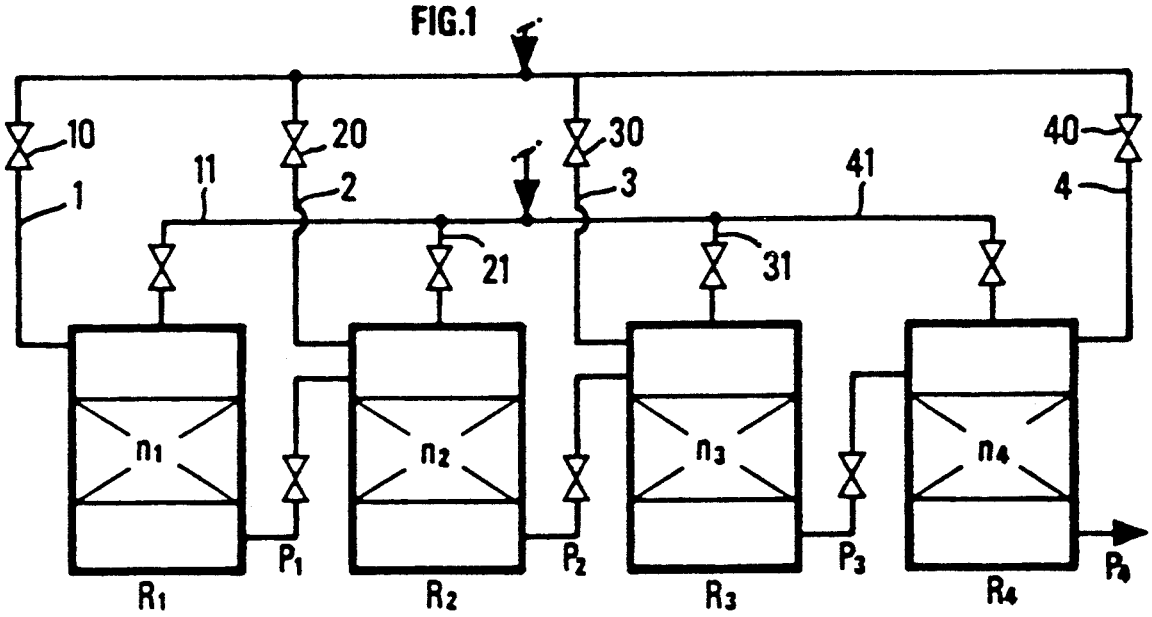
FIG. 1 shows the process applied to a plurality of separate reactors, FIG. 2 in a single reactor.
Figure 2:
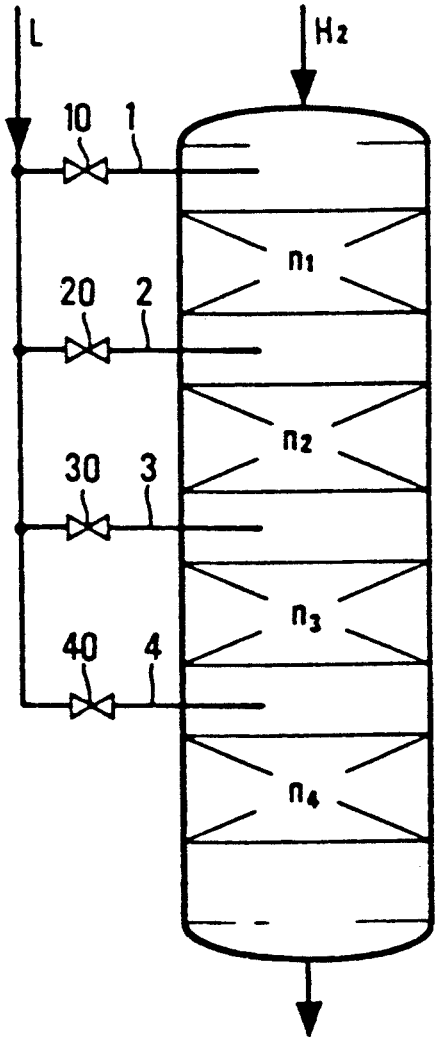

More precisely, referring to FIGS. 1 and 2 in which p=4, when $p_4$ reaches its desired quality threshold S, the valve 40 is closed (preferably progressively), thus stopping the introduction of charge into $n_4$ and at the same time the valve 30 is opened in such a way as to feed the bed $n_3$ with the charge by way of the conduit 3.

The product $p_3$, which is obtained after the charge has passed over $n_3$, passes over the bed $n_4$ (downstream). It issues at $p_4$ from the bed $n_4$. When measurements indicate, in comparison with the specified quality terms, that $p_4$ is no longer of the desired quality, the procedure is the same as previously, involving closure of the valve 30 while at the same time the valve 20 is opened to feed the bed $n_2$ by way of the conduit 2. The product $p_2$ issuing from that bed then passes over the bed $n_3$, the product $p_3$ issuing from $n_3$ passes over the bed $n_4$ and the final product $p_4$ is extracted.

This progression continues as far as the last bed $n_1$ which is fed by way of a conduit 1 provided with a valve 10.

The hydrogen required for the reaction is supplied for example by means of conduits 41, 31, 21 and 11 which are successively brought into service over the beds involved in a reaction.

Four beds have been shown to illustrate the invention, but it will be appreciated that the invention applies to p beds.

When the last bed $n_1$ is brought into service and the product $p_p$ obtained is of a lower quality than that desired, it is then advantageously possible, progressively, to increase the temperature of the total mass of catalyst in order to re-attain and maintain the quality demanded of the product, $p_p$, for example, until complete reactivation of the catalyst occurs.

The use of a single reactor is particularly advantageous in regard to cost but the reactor can operate only with a downward flow, the bed $n_p$ being the lowest and the bed $n_1$ having to the highest.

The inventors have thus found surprisingly, as demonstrated by the examples, that in comparison with a hydrogenation process using a single bed of a mass M of catalyst, their procedure, with the same total mass M of catalyst (the sum of all the beds $n_1$ to $n_p$), gives considerably longer cycle times (a gain of 57% in the example).

The operator may also prefer to use smaller amounts of catalyst (total mass less than M) for comparable cycle times.

The following examples illustrate the invention.

EXAMPLE 1

(Comparison)

This procedure uses a catalyst test unit comprising four reactors which can operate in series, the effluent from the first being transferred into the second and then into the third and then into the fourth.

These reactors, which simulate each bed, are formed by a steel tube which is 3 cm in diameter. Each of the reactors can be heated by an electric furnace which makes it possible to maintain the desired temperature in each of the beds. It is possible to use the array of the reactors as described above, that is to say No 1, No 2, No 3 and No 4 in series, but the device also makes it possible to use reactor 4 alone or else 3 and 4 in series or else 2, 3 and 4 in series.

The procedure involves using 400 $cm^3$ of catalyst LD 265 from Société Procatalyse containing 0.3% of palladium supported on alumina in the four reactors disposed in series in an amount of 100 $cm^3$ per reactor. The catalyst is reduced by hydrogen which is supplied for a period of 6 hours at 150° C. at a rate of 40 l/h.

A measurement is then taken of the hydrogenating activity of the 400 $cm^3$ of catalyst upon the diolefins contained in a steam cracking volatiles stream the following characteristics:

| | |
|---|---|
| - distillation rate | 39–181° C. |
| - relative density | 0.834 |
| - sulphur | 150 ppm |
| - dienes | 16% by weight |
| - olefins | 4% by weight |
| - aromatics | 68% by weight |
| - paraffins | 12% by weight |

The test conditions are as follows:

| | |
|---|---|
| - pressure | 30 bars |
| - temperature | 80° C. initially |
| - hydrocarbon flow rate | 500 $cm^3$/h |
| - hydrogen flow rate | 100 l/h |

The levels of performance are measured by the variation in the maleic anhydride index (MAI) between the intake of the first reactor and the discharge from the fourth. The temperature is fixed at 80° C. in all of the reactors at the beginning of operation and then regularly increased to 120° C. to re-establish the level of conversion as it decreases. The charge gives an MAI of 106. The MAI of the products are given in dependence on time and the operating temperature in Table 1.

TABLE 1

| Operating time in hours | Temperature | Outlet MAI |
|---|---|---|
| 50 | 80 | <2 |
| 100 | 80 | <2 |
| 200 | 80 | <2 |
| 500 | 80 | 2.2 |
| 750 | 80 | 2.3 |
| 820 | 80 | 2.8 |
| 950 | 80 | 3.8 |
| 1160 | 95 | <2 |
| 1300 | 95 | 4 |
| 1400 | 110 | <2 |
| 1540 | 110 | 5 |
| 1600 | 120 | <2 |
| 1800 | 120 | 8 |

It can be seen from this Table that the arrangement in four beds which are successively traversed makes it possible to maintain the product at the outlet from the reaction section at an MAI which is lower than 3 for a period of about 1500 hours.

EXAMPLE 2

(According to the Invention)

The test is conducted using the reactor of FIG. 2. Therefore the four reactors are charged with the same amounts of the same catalyst and the assembly is activated in the same manner as above, and then the levels of performance are measured in dependence on time in the same manner as above.

However the reactors are used only successively in the following order:

reactor 4, reactor 3+reactor 4, reactor 2+reactor 3+reactor 4, reactor 1+reactor 2+reactor 3+reactor 4.

A new reactor is brought into service when the assembly in operation no longer makes it possible to achieve an MAI of lower than 3 at the outlet for a temperature of 80° C. Then the temperature of the four reactors is progressively increased in order to re-establish the required level of performance.

The MAI of the products are specified as well as the arrangement of the reactors and the operating temperature in dependence on time in Table 2.

TABLE 2

| Operating time in hours | Arrangement | Temperature | outlet MAV |
|---|---|---|---|
| 50 | 4 | 80 | <2 |
| 100 | 4 | 80 | <2 |
| 200 | 4 | 80 | 2.4 |
| 500 | 4 | 80 | 2.8 |
| 600 | 4 | 80 | 3.8 |
| 700 | 3,4 | 80 | <2 |
| 800 | 3,4 | 80 | <2 |
| 1000 | 3,4 | 80 | 2.5 |
| 1200 | 3,4 | 80 | 3.2 |
| 1300 | 2,3,4 | 80 | <2 |
| 1400 | 2,3,4 | 80 | <2 |
| 1600 | 2,3,4 | 80 | 2.7 |
| 1800 | 2,3,4 | 80 | 3 |
| 1900 | 1,2,3,4 | 80 | <2 |
| 2000 | 1,2,3,4 | 80 | <2 |
| 2200 | 1,2,3.4 | 80 | 2.5 |
| 2400 | 1,2,3,4 | 80 | 3.8 |
| 2800 | 1,2,3.4 | 90 | <2 |
| 2950 | 1,2,3.4 | 90 | 3.7 |
| 3000 | 1,2.3.4 | 95 | <2 |
| 3280 | 1,2,3,4 | 95 | 2.6 |
| 3300 | 1,2,3,4 | 100 | <2 |
| 3480 | 1.2.3,4 | 100 | 3 |
| 3500 | 1,2,3,4 | 115 | <2 |
| 2590 | 1,2.3,4 | 115* | 3.7 |
| 3600 | 1.2.3.4 | 120 | <2 |

It can be seen that, but using it progressively in accordance with the present invention, using the same amount of catalyst as in Example 1 makes it possible to achieve a much longer satisfactory operating time.

EXAMPLE 3

(Comparative)

This Example uses 400 $cm^3$ of catalyst LD 241 from Société Procatalyse containing 10% of nickel supported on alumina in four reactors arranged in series in a proportion of 100 $cm^3$ per reactor.

This catalyst is reduced by hydrogen which flows for a period of 15 hours at 400° C. at a rate of 40 l/h.

The activity of the catalyst is then measured under the same conditions as Example 1.

The MAI of the products are given in dependence on time as well as the operating temperature in Table 3.

TABLE 3

| Operating time in hours | Temperature | outlet MAV |
|---|---|---|
| 40 | 80 | <2 |
| 70 | 80 | <2 |
| 100 | 80 | 2 |
| 400 | 80 | 4.2 |
| 420 | 95 | <2 |
| 470 | 95 | 2.7 |
| 500 | 95 | 3.2 |

TABLE 3-continued

| Operating time in hours | Temperature | outlet MAV |
|---|---|---|
| 520 | 110 | <2 |
| 540 | 110 | <2 |
| 600 | 110 | 3.1 |
| 620 | 120 | <2 |
| 640 | 120 | <2 |
| 650 | 120 | 2.5 |
| 670 | 120 | 2.9 |
| 700 | 120 | 3.2 |

It can be seen from this Table that the arrangement in four beds which are successively traversed makes it possible to maintain the product at the outlet of the reaction section at an MAI which is lower than 3 for a period of about 700 hours.

EXAMPLE 4

(According to the Invention)

This Example now uses the same catalyst LD 241, but using the arrangement of Example 2.

Table 4 shows the MAI of the products and the arrangement of the reactors and the operating temperature in dependence on time.

It will be seen that using the same amount of catalyst as in Example 3, but using it progressively in accordance with the present invention makes it possible to provide a much longer satisfactory operating time.

TABLE 4

| Operating time in hours | Arrangement | Temperature | outlet MAV |
|---|---|---|---|
| 40 | 4 | 80 | <2 |
| 80 | 4 | 80 | <2 |
| 100 | 4 | 80 | 2 |
| 300 | 4 | 80 | 4 |
| 320 | 3,4 | 80 | <2 |
| 340 | 3,4 | 80 | <2 |
| 370 | 3,4 | 80 | 2.8 |
| 400 | 3,4 | 80 | 3.4 |
| 420 | 2,3,4 | 80 | <2 |
| 450 | 2,3,4 | 80 | <2 |
| 480 | 2,3,4 | 80 | 2.1 |
| 500 | 2,3,4 | 80 | 2.9 |
| 520 | 1,2,3,4 | 80 | <2 |
| 560 | 1,2,3,4 | 80 | <2 |
| 600 | 1,2,3.4 | 80 | 2.4 |
| 640 | 1,2,3,4 | 80 | 3.4 |
| 650 | 1,2,3,4 | 95 | <2 |
| 680 | 1,2,3.4 | 95 | <2 |
| 700 | 1,2,3,4 | 95 | 2.5 |
| 740 | 1,2,3,4 | 95 | 3.4 |
| 760 | 1,2,3,4 | 110 | <2 |
| 800 | 1,2,3,4 | 110 | <2 |
| 860 | 1,2,3,4 | 110 | 3.2 |
| 880 | 1,2,3,4 | 110 | <2 |
| 900 | 1,2,3,4 | 110 | <2 |
| 930 | 1,2,3,4 | 120 | 2.9 |
| 950 | 1,2,3,4 | 120 | <2 |
| 990 | 1,2,3,4 | 120 | <2 |
| 1020 | 1,2,3,4 | 120 | 2.5 |
| 1100 | 1,2.3.4 | 120 | 2.9 |

We claim:

1. A process for the hydrogenation of a hydrocarbon charge to obtain a final product, $p_p$, having a desired quality by contacting the charge with p catalytic beds, $n_1 \ldots n_i \ldots n_p$, wherein $n_i$ designates each bed $n_1$ to $n_p$, and the initial value of i is p−1, said beds being separate and containing the same catalyst, which process comprises:

(A) introducing the charge into bed $n_p$ and removing the final product $p_p$;

(B) when the final product $p_p$ no longer attains the desired quality, stopping the introduction of the charge into the bed $n_p$;

(C) simultaneously with (B), introducing the charge into a bed $n_i$, and obtaining a product $p_i$;

(D) introducing the product $p_i$ from the bed $n_i$ into the bed $n_p$ and removing therefrom the final product $p_p$;

(E) when the final product $p_p$ no longer attains the desired quality, stopping the introduction of the charge into the bed $n_i$;

(F) simultaneously with (E), introducing the charge into the bed $n_{i-1}$, and obtaining a product $p_{i-1}$;

(G) introducing the product $p_{i-1}$ obtained from the bed $n_{i-1}$ through each of beds $n_i$ to $n_p$ successively;

(H) removing the final product $P_p$; and (I) repeating steps (E) through (H) until i has assumed all the values from p to 1.

2. The process of claim 1 wherein the catalytic beds are arranged successively and separately one above the other, the bed $n_p$ being the lowest bed and bed $n_1$ being the highest bed, and the charge ultimately flows downward through the beds.

3. The process of claim 2, wherein all the catalytic beds are arranged successively and separately within a single reactor, the final product being removed at the bottom of the reactor.

4. The process of claim 1, wherein the hydrocarbon charge contains diolefins.

5. The process of claim 1, wherein the charge comprises volatiles produced from a cracking process.

6. The process of claim 5, wherein the cracking process is a steam cracking process.

7. The process of claim 1, wherein after introducing the charge into the last bed, $n_1$, and after the final product $p_p$ falls below the desired quality, progressively increasing the temperature of the total mass of catalyst in each bed, thus re-attaining and maintaining the desired quality of the final product $p_p$ until complete deactivation of the catalyst occurs.

8. A process for the selective hydrogenation of a hydrocarbon charge comprising diolefins to obtain a final product, $p_p$, having a desired quality with a catalyst comprising at least one Group VIII metal deposited on a carrier, by contacting the charge with p catalytic beds $n_1 \ldots n_i \ldots n_p$, wherein $n_i$ designates each bed $n_1$ to $n_p$, and the initial value of i is $p-1$, said beds being separate and containing the same catalyst, which process comprises:

(A) introducing the charge into bed $n_p$ and removing the final product $p_p$;

(B) when the final product $p_p$ no longer attains the desired quality, stopping the introduction of the charge into the bed $n_p$;

(C) simultaneously with (B), introducing the charge into a bed $n_i$, and obtaining a product $p_i$;

(D) introducing the product $p_i$ from the bed $n_i$ into the bed $n_p$ and removing therefrom the final product $p_p$;

(E) when the final product $p_p$ no longer attains the desired quality, stopping the introduction of the charge into the bed $n_i$;

(F) simultaneously with (E), introducing the charge into the bed $n_{i-1}$, and obtaining a product $p_{i-1}$;

(G) introducing the product $p_{i-1}$ obtained from the bed $n_{i-1}$ through each of beds $n_i$ to $n_p$ successively;

(H) removing the final product $P_p$; and (I) repeating steps (E) through (H) until i has assumed all the values from p to 1.

* * * * *